United States Patent [19]

Rebold

[11] 3,977,077

[45] Aug. 31, 1976

[54] CONVERTIBLE SWIVEL KNIFE

[75] Inventor: Jerome Rebold, Timonium, Md.

[73] Assignee: CBS Inc., New York, N.Y.

[22] Filed: Sept. 2, 1975

[21] Appl. No.: 609,492

[52] U.S. Cl. ..... 30/151; 30/317; 30/321

[51] Int. Cl.[2] ..... B26B 1/04

[58] Field of Search ..... 30/151, 164.9, 317, 30/321; 145/50 R

[56] References Cited

UNITED STATES PATENTS

| | | | |
|---|---|---|---|
| 925,278 | 6/1909 | Bickford | 30/151 |
| 2,512,237 | 6/1950 | Mravik | 30/151 |
| 3,080,653 | 3/1963 | Dolin | 30/317 |
| 3,831,276 | 8/1974 | Dalton et al. | 30/317 X |
| 3,886,656 | 6/1975 | Meshulam | 30/321 X |
| 3,922,784 | 12/1975 | Prince et al. | 30/317 |

*Primary Examiner*—Al Lawrence Smith
*Assistant Examiner*—J. C. Peters
*Attorney, Agent, or Firm*—Spencer E. Olson

[57] ABSTRACT

A swivel knife that is convertible for use as a conventional knife wherein the blade is rigidly mounted. A tubular housing having front and rear ends has an elongated generally cylindrical stem mounted therein and normally rotatable with respect thereto. The stem has a blade-holding end at the front of the housing and a free end at the rear of the housing. The stem is proportioned at the free end to be radially spaced from the housing. A cap member is provided in the shape of a hollow generally cylindrical shell proportioned to be forcibly inserted in the space between the housing and the free end to prevent relative rotation of the stem in the housing.

9 Claims, 4 Drawing Figures

CONVERTIBLE SWIVEL KNIFE

BACKGROUND OF THE INVENTION

This invention relates to cutting tools and, more particularly, to an improved convertible swivel knife.

There have been previously devised many types of hand-held cutting tools for use by craftsmen such as draftsman, artists, photographers, etc. The majority of such cutting tools employ a small blade that is rigidly mounted at the end of a housing. This type of knife is satisfactory for use in certain applications but has been found deficient in applications where it is necessary to cut curved shapes. The disadvantage stems from the need to continually twirl the fingers or lift the hand to impart the required curved impetus to the cutting blade.

Responsive to the described need there has been developed a type of cutting tool known as a "swivel knife" which employs a blade that is free to rotate about the axis of the cutting tool. Thus, as the craftsman's hand is moved around the curve, the blade will orient itself in the direction required for continued motion and the amount of twirling of the fingers or lifting of the hand that was previously necessary is substantially diminished. In order to make this type of cutting tool more versatile and equally suitable for applications where a rigid blade would be more desirable, provision is often made for rendering the blade-holding mechanism of such knives stationary with respect to the knife housing; i.e., preventing rotation of the blade with respect to the housing. Generally, the blade is attached to the central shaft which is rotatable within the knife housing and the usual technique is to provide a small bore through the shaft in which a pin can be inserted. The bore is accessible by removal of a cover at the top of the cutting instrument. Therefore, when it is desired to convert the action of the knife from "swivel" to "non-swivel", or vice versa, it is necessary to remove the cap, either insert or remove the pin, and then replace the cover. This technique is somewhat inconvenient in that it requires the manipulation and storage of a pin element that is quite small.

Improved techniques for convertible swivel knives have been devised with the mechanisms employed requiring, for example, threaded elements which must be turned by the user. Such techniques tend to increase the manufacturing cost of the knives by requiring precision threaded parts and/or an increase in the number of parts needed to perform the required function. Examples of these techniques are shown in U.S. Pat. Nos. 2,569,286 and 3,831,276.

A further problem with prior art swivel knives relates to the provision for bearings which allow smooth relative rotation as between the blade-holding shaft and its housing. If no restrictions on size or expense were necessary, precision bearings could be readily provided. However, a convertible swivel knife is a hand-held tool which must necessarily be limited in length and diameter and have reasonably good weight distribution and balance. Accordingly, any bearing system provided should be compact, easy to assemble, and have a minimum number of parts, while still performing an optimum function.

It is an object of this invention to provide an improved swivel knife which overcomes the disadvantages of presently available cutting tools.

SUMMARY OF THE INVENTION

The present invention is directed to a swivel knife that is convertible for use as a conventional knife wherein the blade is rigidly mounted. In accordance with the invention there is provided a tubular housing having front and rear ends. An elongated generally cylindrical stem is mounted in the housing and normally rotatable with respect thereto. The stem has a blade-holding end at the front of the housing and a free end at the rear of the housing. The stem is proportioned at the free end to be radially spaced from the housing. Further provided is a cap member comprising a hollow generally cylindrical shell proportioned to be forcibly inserted in the space between the housing and the free end so as to prevent relative rotation of the stem in the housing.

In the preferred embodiment of the invention, the housing has an inner annular groove frontwardly therein and the stem tapers circumferentially at a position registered with one edge of the annular groove. In this embodiment, an annular element is mounted on the narrowed blade-holding end of the stem, the element having a tapered surface positionally registered with the other edge of the annular groove. A plurality of ball bearings are adapted for retention in the groove, the tapered portions of the stem and the annular element serving as a race for the ball bearings during relative rotation between the stem and the housing.

Further features and advantages of the invention will become more readily apparent from the following detailed description when taken in conjunction with the accompanying drawings.

DESCRIPTION OF THE PREFERRED EMBODIMENT

Figure 1:
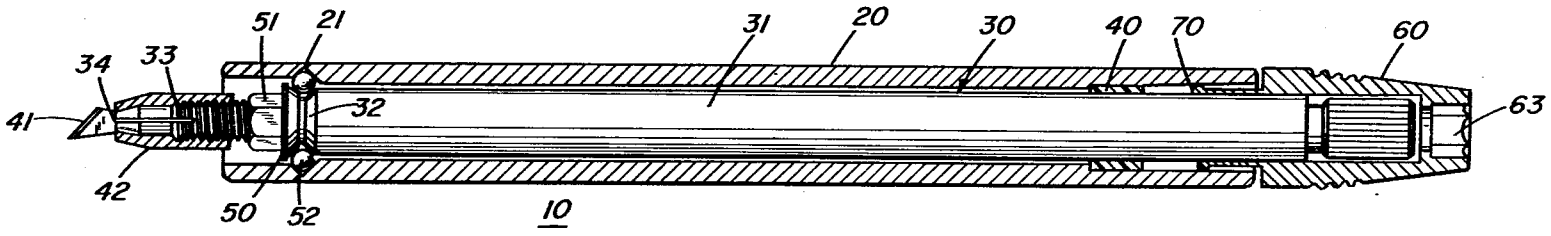
FIG. 1 is a cross-sectional view of a convertible swivel knife in accordance with the invention, the knife being in a rigid mode with its cap member mounted at the rear thereof.
Figure 2:
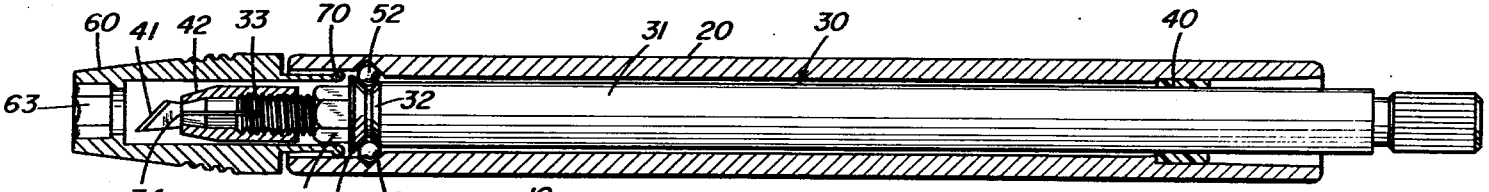
FIG. 2 is another cross-sectional view, but with the cap member mounted over the knife blade at the front of the knife.

Referring to FIGS. 1 and 2 there is shown a convertible swivel knife 10 in accordance with the invention. A cylindrical housing 20, preferably formed of aluminum, is provided with an annular V-groove 21 frontwardly therein. The housing 20 tapers slightly to a larger inner circumference at the rear end thereof.

Figure 3:
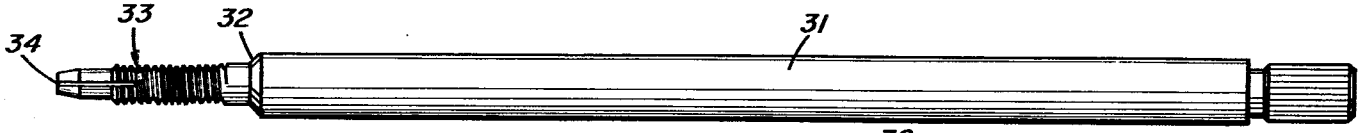
FIG. 3 is a perspective view of the stem of the knife of FIG. 1.

A central shaft of stem 30 is mounted in the housing and normally adapted for rotation on its axis with respect to the housing. In the present embodiment, the stem is longer than the housing and extends substantially beyond both ends thereof. The stem 30, shown separately in FIG. 3, comprises an elongated cylindrical body 31 which is slightly smaller in diameter than the inner diameter of housing 20 to facilitate free rotation within a plastic bearing 40 and ball bearings to be described. The stem narrows at a tapered portion 32 to its blade-holding end 33 which is threaded and has a forked receptacle 34 which receives blade 41. A collet 42 engages the threaded portion and holds the blade in place by tightening the receptacle in conventional fashion.

An annular element 50 is mounted on the narrowed end 33 of stem 30. The element 50 has a tapered surface, as shown, and is held in place by a nut 51. A plurality of ball bearings 52, twelve being used in this particular embodiment, are retained in the groove 21 and between the tapered surface 32 of stem 30, these surfaces serving as a race for the ball bearings 52.

Figure 4:
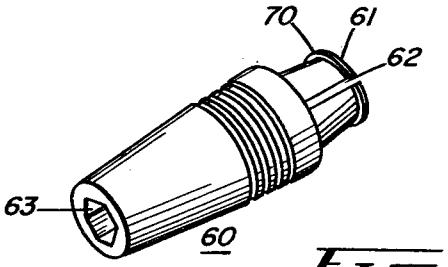
FIG. 4 is a perspective view of the cap member of FIG. 1.

A cap member 60, shown separately in FIG. 4, is in the form of a cylindrical shell, grooved in part for gripping, which has an edge 61 proportioned to be forcibly inserted in the space between the housing and the free end of the stem, as shown in FIG. 2. Insertion is facilitated by the slight rearward taper of the housing and by providing slots 62 and a small end lip 70 on the edge 61. The thickness of the inserted edge of cap member 60 is selected to be sufficiently wide to radially stress the housing so that it squeezes the cap against the stem 30 and prevents rotation as between the stem and the housing.

The housing 20 is proportioned at its front end to receive and retain the cap, so that when the knife is not in use, the cap can serve as a cover for the blade, as shown in FIG. 2. The opposite end of cap 60 is provided with a hexagonal opening 63 which can serve as a wrench for use in loosening and/or tightening the collet 42 and the nut 51.

Due to its small number of parts and unique construction, the knife can be easily assembled or disassembled. To assemble, the stem 30 is inserted in the housing 20 with the bearing 40 in place. The ball bearings 52 are then dropped into the front of the housing (while held vertically) and the annular element is mounted over the narrowed end of the stem and secured in place by nut 51. The blade and the collet 42 are then secured in conventional fashion. The nut 51 is adjustable to eliminate looseness, so as to provide a relatively precise bearing. The tapered surface of element 50 insures that axial and radial looseness can be minimized.

During operation in the swivel mode the ball bearings insure a smooth axial rotation in additon to serving the additional function of preventing relative longitudinal movement as between the housing and stem.

I claim:

1. A swivel knife that is convertible for use as a conventional knife wherein the blade is rigidly mounted, comprising:

a tubular housing having front and rear ends;

an elongated generally cylindrical stem mounted in said housing and normally rotatable with respect thereto, said stem having a blade-holding end at the front of said housing and a free end at the rear of said housing, said stem being proportioned at said free end to be radially spaced from said housing; and a cap member comprising a hollow generally cylindrical shell proportioned to be forcibly inserted in the space between said housing and said free end so as to prevent relative rotation of said stem in said housing.

2. A knife as defined by claim 1 wherein said housing is proportioned at its front end to receive and retain said cap.

3. A knife as defined by claim 1 wherein the rear end of said housing is tapered to facilitate insertion of said cap member.

4. A swivel knife comprising:

a tubular housing having front and rear ends, said housing having an inner annular groove frontwardly therein;

an elongated cylindrical stem mounted in said housing and proportioned to conform generally to the inner surface of said housing so as to be rotatable with respect thereto, said stem tapering circumferentially to a bladeholding end toward the front of said housing, said taper being positionally registered with one edge of said annular groove;

an annular element mounted on the narrowed bladeholding end of said stem, said element having a tapered surface positionally registered with the other edge of said annular groove; and a plurality of ball bearings adapted for retention in said groove whereby the taper of said stem and the taper of said annular element serve as a race for said ball bearings during rotation of said stem with respect to said housing.

5. A knife as defined by claim 4 wherein said annular element is adjustably mounted on said stem whereby said annular element can be adjustably tightened against said ball bearings.

6. A swivel knife that is convertible for use as a conventional knife wherein the blade is rigidly mounted, comprising:

a tubular housing having front and rear ends, said housing having an inner annular groove frontwardly therein;

an elongated cylindrical stem mounted in said housing and proportioned to conform generally to the inner surface of said housing so as to be rotatable with respect thereto, said stem having a free end at the rear of said housing, said stem being proportioned at said free end to be radially spaced from said housing, said stem tapering circumferencially to a blade-holding end toward the front of said housing, said taper being positionally registered with one edge of said annular groove;

an annular element mounted on the narrowed bladeholding end of said stem, said element having a tapered surface positionally registered with the other edge of said annular groove;

a plurality of ball bearings adapted for retention in said groove whereby the taper of said stem and the taper of said annular element serve as a race for said ball bearings during rotation of said stem with respect to said housing; and a cap member comprising a hollow generally cylindrical shell proportioned to be forcibly inserted in the space between said housing and said free end so as to prevent relative rotation of said stem in said housing.

7. A knife as defined by claim 6 wherein said housing is proportioned at its front end to receive and retain said cap.

8. A knife as defined by claim 6 wherein the rear end of said housing is tapered to facilitate insertion of said cap member.

9. A knife as defined by claim 6 wherein said annular element is adjustably mounted on said stem whereby said annular element can be adjustably tightened against said ball bearings.

* * * * *